United States Patent [19]

Dürr

[11] Patent Number: 4,998,678

[45] Date of Patent: Mar. 12, 1991

[54] AGITATOR BALL MILL

[75] Inventor: Herbert Dürr, Buchen, Fed. Rep. of Germany

[73] Assignees: Walter Eirich; Paul Eirich; Hubert Eirich

[21] Appl. No.: 437,704

[22] Filed: Nov. 17, 1989

[30] Foreign Application Priority Data

Nov. 18, 1988 [DE] Fed. Rep. of Germany ..... 3838981

[51] Int. Cl.[5] ..... B02C 17/16

[52] U.S. Cl. ..... 241/171; 241/172

[58] Field of Search ..... 241/65, 66, 67, 171, 241/172, 101.3

[56] References Cited

U.S. PATENT DOCUMENTS

| | | | |
|---|---|---|---|
| 1,956,293 | 4/1934 | Klein et al. | 241/172 X |
| 2,651,582 | 9/1953 | Courtney . | |
| 3,311,310 | 3/1967 | Engels et al. . | |
| 3,342,459 | 9/1967 | Myers et al. . | |
| 4,243,183 | 1/1981 | Eirich et al. . | |
| 4,244,531 | 1/1981 | Szegvari | 241/172 |
| 4,303,205 | 12/1981 | Geiger et al. | 241/172 X |
| 4,304,362 | 12/1981 | Buehler . | |
| 4,673,134 | 6/1987 | Barthelmess | 241/172 X |

FOREIGN PATENT DOCUMENTS

| | | | |
|---|---|---|---|
| 0219036 | 10/1986 | European Pat. Off. . | |
| 0266165 | 5/1988 | European Pat. Off. . | |
| 1073280 | 1/1960 | Fed. Rep. of Germany . | |
| 1133614 | 7/1962 | Fed. Rep. of Germany | 241/172 |
| 1200656 | 9/1965 | Fed. Rep. of Germany . | |
| 1223236 | 8/1966 | Fed. Rep. of Germany . | |
| 1254000 | 11/1967 | Fed. Rep. of Germany . | |
| 1482391 | 11/1972 | Fed. Rep. of Germany . | |
| 2240751 | 1/1980 | Fed. Rep. of Germany . | |
| 2836969 | 3/1980 | Fed. Rep. of Germany . | |
| 2811899 | 12/1984 | Fed. Rep. of Germany . | |
| 3345799 | 6/1985 | Fed. Rep. of Germany . | |
| 3536454 | 4/1987 | Fed. Rep. of Germany . | |
| 2654887 | 6/1987 | Fed. Rep. of Germany . | |
| 2806315 | 11/1987 | Fed. Rep. of Germany . | |
| 3614721 | 11/1987 | Fed. Rep. of Germany . | |
| 3615491 | 11/1987 | Fed. Rep. of Germany | 241/172 |
| 221925 | 5/1985 | German Democratic Rep. | 241/172 |
| 1260018 | 9/1986 | U.S.S.R. | 241/172 |
| 336021 | 10/1930 | United Kingdom | 241/172 |

*Primary Examiner*—Mark Rosenbaum

*Attorney, Agent, or Firm*—Browdy and Neimark

[57] ABSTRACT

An agitator ball mill comprises a grinding container having a cylindrical grinding chamber which is defined by a grinding-chamber wall. At least one agitator, which is provided with projecting agitating tools is arranged in said grinding chamber. The agitator and the grinding container can be rotatably driven about their respective axes which are parallel to each other. The grinding chamber is partially filled with auxiliary grinding bodies and has a grinding-stock supply means and a grinding-stock discharge means comprising a grinding-stock/auxiliary-grinding-bodies separating device. The agitator axis has an eccentricity with respect to the central longitudinal axis of the grinding chamber. In addition, at least one stationary deflector having a deflecting face which is open in the direction of the central longitudinal axis, is provided in the region of the grinding-chamber wall, which deflector is directed from the latter into the grinding chamber and extends across a substantial portion of the length of the grinding chamber.

36 Claims, 10 Drawing Sheets

AGITATOR BALL MILL

FIELD OF THE INVENTION

The invention relates to an agitator ball mill comprising a grinding container having a cylindrical grinding chamber, which is defined by a grinding-chamber wall, and at least one agitator which is arranged in said grinding chamber and is provided with projecting agitating tools and the agitator axis of which extends parallel with the central longitudinal axis of the grinding chamber, wherein the agitator, on the one hand, and the grinding container, on the other hand, can be rotationally driven about their respective axis by means of a drive, wherein the grinding chamber is partially filled with auxiliary grinding bodies which are fairly freely movable in a mixture of grinding stock and auxiliary grinding bodies, and wherein the grinding chamber is provided with a grinding-stock feed means and a grinding-stock discharge means comprising a grinding-stock-/auxiliary-grinding-bodies separating device

BACKGROUND OF THE INVENTION

Agitator ball mills for the comminution of solid matter have been known for some time. In practice, they are used, virtually exclusively, for the so-called wet crushing process, i.e. the solid matter to be ground is comminuted in a suspension or dispersion with a liquid, e.g. water, solvent, binding medium or the like, and, in this connection, is simultaneously dispersed in the liquid. It has also already become known to use agitator ball mills in respect of a so-called dry crushing process, i.e. for a comminution of solid matter without the presence of a liquid. This has, however, not proved successful in practice.

From U.S. Pat. No. 3,311,310, an agitator ball mill is known which has a substantially vertically arranged cylindrical grinding container, in which is arranged, to be driven at high speed, a concentrically arranged agitator. The latter comprises an agitator shaft with substantially radially projecting agitating tools attached thereto, said tools being in the form of annular discs or agitating arms, or the like. The grinding chamber of this agitator ball mill is filled, for example, with sand as auxiliary grinding bodies or with corresponding auxiliary grinding bodies of glass, steel or any other suitable hard material, up to 75% of its clear volume. A grinding-stock suspension is pressed into the grinding chamber at the bottom end of the grinding container by means of a pump and leaves the grinding chamber at the top end, one it has passed through a grinding-stock/auxiliary-grinding-bodies separating device. The latter has a ring, which is attached to a lid of the grinding container, and a disc which rotates with the agitator shaft. A separating slot, the width of which is smaller than the diameter of the smallest auxiliary grinding bodies used and which becomes wider conically in an outward direction from the grinding chamber, is provided between said disc and the ring. The slot width is adjustable by the axial displacement of the disc relative to the ring. A separating device of this kind permits, in contrast to a simple screen or the like as the separating means, the grinding of grinding stock having a high viscosity, such as, for example, highly viscous printing inks, chocolate pastes, or the like. A so-called dry communication of solid matter is also not possible the case of these agitator ball mills, which can also be arranged horizontally or in any inclined intermediate position between vertical and horizontal. These known agitator ball mills are usually surrounded by a tempering jacket, which encloses the wall of the grinding chamber and which usually serves the purpose of cooling, i.e. to remove the energy introduced during grinding and converted into heat. It is precisely in the case of highly viscous grinding stock that the viscosity is very distinctly increased as the temperature is reduced. The consequence hereof is that, in the region of the grinding-chamber wall, due to the more intensive cooling there, a boundary layer of grinding stock having a particularly high viscosity builds up which, in turn, as a result of its insulating effect, impedes the conveying of heat from the grinding stock, which is disposed deeper in the interior of the grinding chamber, to the grinding-chamber wall, or, indeed, makes such conveying virtually impossible. This results in a restriction of the application possibilities of such agitator ball mills.

Agitator ball mills for use in the dry crushing of solid matter have become known. The basic structure of the agitator ball mill, namely a substantially vertically arranged grinding container and, arranged concentrically therein, an agitator means which can be driven at high speed, and a partial filling of the grinding chamber with auxiliary grinding bodies, has, in this regard, been retained. The solid matter to be comminuted is supplied to the grinding chamber from below by means of air, and leaves the grinding chamber at the top end, using the conveying action of the air current It has been found, in practical tests, that the residence time of the particles of solid matter to be comminuted in the grinding chamber is so wide-ranging that the result of grinding is completely unsatisfactory, since no adequately uniform particle fineness of the solid matter is achieved. In addition, the grinding stock settles on the grinding-chamber wall and results in a coating having a thickness such that there may be considerable interference in the operation of the mill.

An agitator ball mill having a slot-shaped grinding chamber has become known from U.S. Pat. No. 4,304,362. In this connection, a slot-shaped grinding chamber, which has a conical shape in its overall cross-section, is formed between a rotor and a stator. In this case, the auxiliary grinding bodies have rolling contact with the surface of the rotor or the grinding container. The auxiliary grinding bodies, in this instance, do not have free mobility. It is for this reason that dry crushing is impossible.

From German published patent application 35 36 454, an annular-passage ball mill for the continuous fine grinding of hard mineral material is known, in the case of which, in a closed grinding container is arranged a rotor, the outer surface of which defines a grinding slot together with the inner surface of the grinding container. Auxiliary grinding bodies are arranged in this grinding slot. The top part and the bottom part of the rotor taper in opposite directions. In this connection, not only the rotor, but also the grinding container, is provided with its own rotary drive. For the purpose of changing the grinding-slot width, the rotor or the grinding container can be displaced in a transverse direction relative to the central axis of rotor and grinding container, whereby a changeable eccentircity is achievable between rotor and grinding container. Here, too, a free mobility of the auxiliary grinding bodies is not ensured.

From German published examined patent application 12 23 236, an agitator ball mill of the generic kind is known, in the case of which the grinding container can be rotationally driven about the central longitudinal axis which is concentric with the agitator axis, in order to prevent, due to the centrifugal forces which are hereby exerted on the auxiliary grinding bodies, that they flow to a radially internally-located grinding-stock-discharge opening. The auxiliary grinding bodies are thereby largely deprived of the influence of the agitating tools, with the result that the grinding effect of this agitator ball mill is very slight. In the event of dry crushing, the grinding stock and the auxiliary grinding bodies would accumulate on the rotating inner wal of the grinding chamber, with the result that grinding stock and auxiliary grinding bodies would not execute any relative movements with respect to one another.

From U.S. Pat. No. 4,243,183, a preparation and comminution apparatus is known, which comprises a rotatable drum having rotors arranged therein This apparatus is used for the processing, preparation, mixing and comminution of voluminous, bulky, rough and hard materials. For this reason, the rotors support splitting tools which carry out an "impact-cracking" procedure of the materials to be comminuted. Brittle-fracturing materials are, in this regard, predominantly stressed by impact, whereas viscous materials are torn apart. In addition, balls may be introduced into this apparatus, the splitting tools of the rotors, in this case, serving as catapulting tools. In this regard, the balls render only a small comminution aid, in particular, by surface-impacting of the materials to be comminuted. Fine grinding, as is the case in agitator ball mills, is not possible in this instance.

SUMMARY OF THE INVENTION

It is an object of the invention to develop an agitator ball mill of the generic such that both wet crushing and dry crushing are possible.

According to the invention the agitator axis has eccentricity relative to the central longitudinal axis of the grinding chamber and, in the region of the grinding-chamber wall, at least one stationary deflector is provided which is directed from the latter into the grinding chamber and which extends across a substantial portion of the length of the grinding chamber and which has a deflecting face which is open in the direction of the central longitudinal axis. Using the agitator ball mill according to the invention, it is, surprisingly, possible to carry out both wet crushings, which are usual for agitator ball mills, as well as a so-called dry crushing. As a result of the eccentric arrangement of the agitator relative to the grinding chamber, on the one hand, the free mobility of the auxiliary grinding bodies is ensured and, on the other hand, compression and dispersion zones are formed, which result both in an improvement of the conveyance of heat and prevention of coat formation on the inner wall of the container, with the result that the co-operation of the eccentric arrangement of the agitator relative to the grinding chamber and the independent rotation of the grinding-chamber wall are considerable The rotational speed or the circumferential velocity of the grinding-chamber wall is, in this regard, of importance in respect of the frequency of the stress of each individual particle of grinding stock, whereas the rotational speed of the agitator is of importance for the intensity of processing. For the purpose of optimizing the grinding effect, therefore, the rotational speed of the grinding container must be co-ordinated with the rotational speed of the agitator.

As a result of the rotary motion of the grinding container and the eccentric arrangement of the agitator shaft relative to the grinding chamber, the mixture of grinding stock/auxiliary grinding bodies is, of necessity, conveyed into a contracted cross-sectional region of highest grinding stress. If the rotational speed of the agitator is increased while the circumferential velocity of the grinding-chamber wall remains constant, then this will result in the generation of greater shearing forces, as a result of which a correspondingly greater comminution effect is brought about in the case of grinding stock which requires a greater shearing stress. When the circumferential velocity of the grinding-chamber wall is increased, higher centrifugal accelerations, which act on the auxiliary grinding bodies, set in, which results in a densification of the auxiliary grinding bodies and the coarser components of the grinding stock in the region of the grinding-chamber wall. The consequence hereof is that the coarser particles of grinding stock, which require a greater degree of comminution, are particularly intensively subjected to a comminution action. Also significant for the grinding process is the eccentricity of the agitator relative to the grinding chamber. In the case of a greater degree of eccentricity, i.e. when the radial spacing of the outer periphery relative to the grinding-chamber wall is smaller, the shearing forces, which are released by the rotations of grinding container and agitator, are brought to bear on the grinding stock in a spatially smaller extent. Of necessity, the influence of the sickel-shaped, slot-shaped intensive grinding chamber, i.e. the part of the grinding chamber having a constricted cross-section, through which the grinding stock must pass owing to the conveying effect of the rotating grinding container, increases. After passing through the zone of highest stress, the grinding stock arrives in a so-called dispersion zone which is also still in the contracted cross-sectional region. In the dispersion zone, the newly created surfaces of the comminuted particles of grinding stock are, for example, wetted with the liquid, with the result that, not only is cluster-reforming prevented, but a stabilization of the grinding-stock suspension or grinding-stock dispersion is also achieved. This effect of comminution and subsequent dispersion is repeated. In the case of a dry crushing process, too, cluster-reforming is prevented in the contracted cross-sectional region which follows the most contracted cross-sectional region between agitator and grinding-chamber wall.

By means of the deflector, which is associated with the grinding-chamber wall and which can, simultaneously, also there serve the purpose of stripping device, it is possible to direct the flow of grinding stock/auxiliary grinding bodies into the region of optimal grinding stress. The effects described are, therefore, as a result still further optimized.

It is made possible for various grinding-stock components to be introduced to the grinding process at various points of the grinding chamber and, therefore, at different points of time of grinding.

It is advantageous in particular in respect of dry crushing, when the agitator axis and the central longitudinal axis of the grinding chamber are arranged substantially vertically and when, in an upper free space of the grinding chamber, which free space is not filled with a mixture of grinding stock/auxiliary grinding bodies, a suction device for the fines component of the grinding stock is arranged. By means of the controlled adjusting of rotational speed of agitator and grinding container, a particularly favourable form of the funnel-shaped surface of the mixture of grinding stock/auxiliary grinding bodies can be obtained. As a result of the rotary motion of the grinding container, a certain screening process moreover takes place, whereby coarser particles pass more into the radially outer regions of the grinding chamber. As a result hereof, the grinding process is improved by the greater concentration of auxiliary grinding bodies in the radially outer region. The supply of scavenging air assists the screening process.

If the floor of the grinding chamber is displaceable in the direction of the central longitudinal axis of the grinding chamber, then it is possible, firstly, to change the relative filling of the grinding chamber with auxiliary grinding bodies and, therefore, the grinding effect. Furthermore, it is possible to adjust the distance of the funnel-shaped surface of the mixture of grinding stock-/auxiliary grinding bodies relative to the suction device.

The invention permits, in a particular manner, a dry crushing or a wet crushing of grinding stock of extremely high viscosity.

In order to obtain as narrow a residence-time spectrum as possible in respect of the individual grinding-stock particles in the grinding chamber, it is advantageous to support the grinding container, via a weighing means, on a machine frame and to control the separating device for the purpose of changing the discharge of grinding stock, by means of which it is achieved that the supplied mass flow of grinding stock corresponds, in each case, exactly to the mass flow of discharged finely ground grinding stock.

The measures according to the invention can, generally, be used in continuously working agitator ball mills, which are, therefore, constantly supplied with grinding stock to be ground and from which is removed, in a corresponding manner, ground grinding stock, but also in agitator ball mills which work with batched quantities. The measures according to the invention are, however, all in all, of greater advantage in the case of continuously operating agitator ball mills.

Further advantages and features of the invention will become apparent from the ensuing description of a number of exemplified embodiments, taken in conjunction with drawings.

DESCRIPTION OF THE PREFERRED EMBODIMENTS

Figure 1:
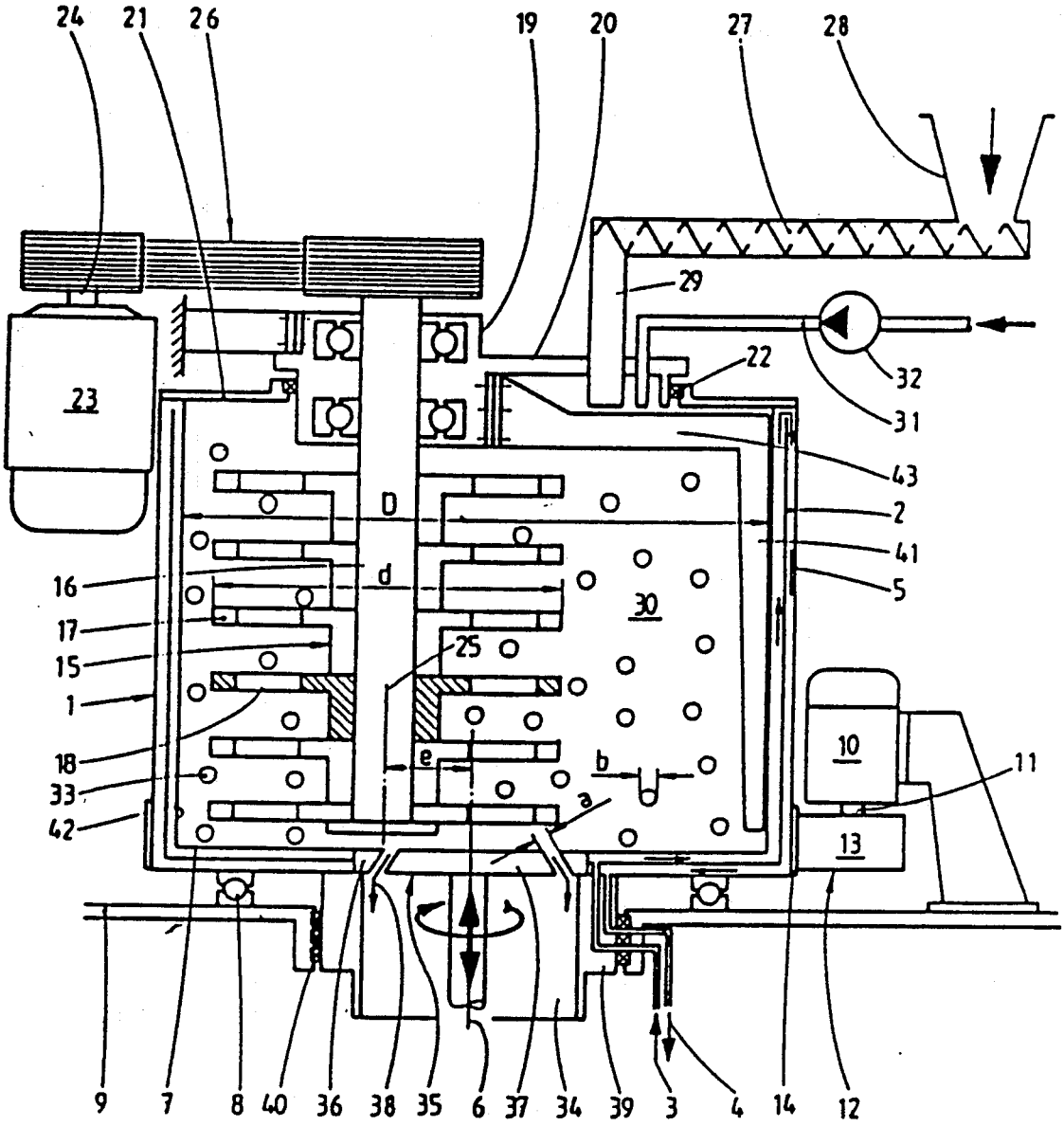
FIG. 1 shows a diagrammatic representation of a vertical central longitudinal section of an agitator ball mill according to the invention.

The agitator ball mill illustrated in FIG. 1 comprises an essentially cylindrical grinding container 1 which is provided with a tempering jacket 2. Communicating with the tempering jacket 2 are an inlet 3, on the one hand, and an outlet 4, on the other hand, for a tempering medium, i.e. for a cooling or heating medium, which flows through the tempering jacket 2 according to the flow-direction arrow 5 shown there. The cylindrical grinding container 1 has a central longitudinal axis 6 which extends vertically, i.e. the grinding container 1 stands vertically. At the bottom, the grinding container 1 is closed by a bottom 7 which extends vertically relative to the axis 6. The grinding container 1 is supported with respect to a machine frame 9, which is merely indicated, via a pivot bearing 8 which is arranged concentrically to the axis 6 and which is designed as a thrust ball bearing, i.e. the grinding container 1 is rotatable about its central longitudinal axis 6. A grinding-container driving motor 10, which is supported with respect to the machine frame 9, is provided as a rotary-drive means for the grinding container 1, the shaft 11 of which driving motor is arranged parallel with respect to the axis 6 and which drives the grinding container 1 via a friction gear 12. To this end, a friction wheel 13 is mounted on the shaft 11 to abut against a ring-cylindrical friction surface 14 which is secured to the outside of the grinding container 1. Due to the great difference between the diameter of the ring-cylindrical friction surface 14, on the one hand, and the friction wheel 13, on the other hand, the grinding container 1 can be driven at a relatively low rotational speed.

Arranged in the grinding container 1 is an agitator 15, which essentially and, in so far, in the usual manner, comprises an agitator shaft 16 and agitating tools 17 arranged thereon. The agitating tools 17 may be agitating discs having penetration openings 18. In its upper region which is opposite the bottom 7, the agitator shaft 16 is over-mounted in an agitator-shaft bearing 19. This bearing is held in an end-face covering 20, which is non-rotatable and which is supported with respect to the machine frame 9 in a manner which is not illustrated. A packing ring 22, which is arranged concentrically with the central longitudinal axis 6 of the grinding container, is placed in position between the covering 20 and a grinding-container lid 21.

The agitator 15 is driven by means of an agitator-driving motor 23, which is connected to the machine frame 9 in a manner not illustrated and the shaft 24 of which extends parallel to the agitator axis 25. The motive power is transmitted to the agitator shaft 16 via a belt drive 26. The agitator axis 25 and the central longitudinal axis 6 extend parallel with respect to each other and are displaced relative to each other by an eccentricity e.

In the non-rotatable covering 20 of the grinding container 1 are arranged means for the addition of various components which are to be brought together and processed in the grinding container 1. In the present instance, these means comprise a feeding screw 27, by means of which solid matter to be comminuted, which is supplied via an input funnel 28, is conveyed to an addition pipe 29 and through the latter into the grinding chamber 30 located in the grinding container 1. In addition, an inlet pipe 31 is provided which passes through the covering 20 into the grinding chamber 30 and through which the liquid is supplied by means of a pump. At least 50% of the grinding chamber 30 is filled with auxiliary grinding bodies 33. This specification refers to the volume per unit of mass of the auxiliary grinding bodies 33 in the clear grinding chamber 30. The clear grinding chamber 30 is equal to the volume of the grinding container 1 minus the volume of the agitator 15 located therein.

The grinding stock flows downward out of the grinding chamber 30 through a grinding-stock discharge duct 34. For the purpose of separating the auxiliary grinding bodies 33 from the grinding stock processed in the grinding chamber 30, an annular-passage separating device 35 is provided, in which, between a ring 36, which is mounted in the bottom 7 of the grinding container 1 concentrically with the axis 6 of the latter and rotating therewith, and a disc 37, a separating slot 38 is provided, the width a of which is distinctly smaller than the diameter b of the smallest auxiliary grinding bodies 33 used. The width a is usually smaller than half the smallest diameter b. The disc 37 is rotatably driven about the axis 6 by means of a driving means which is not illustrated. It can, in addition, be displaced in the direction of the axis 6, as a result of which the width a of the separating slot 38 is changed, since the latter is designed to be frusto-conically shaped. Annular-passage separating devices 35 of this kind are generally known in regard to agitator mills.

The supply of the tempering medium through the inlet 3, and its removal through the outlet 4, are provided via a usual rotating pipe coupling 39 which is sealed, with respect to the machine frame 9, by means of a packing ring 40.

Arranged in the grinding chamber 30 is a deflector 41 which is located in the vicinity or on that cylindrical grinding-chamber wall 42 of the grinding container 1 which outwardly defines the grinding chamber 30. It extends substantially across the axial length of the cylindrical grinding-chamber wall 42. It is connected to the non-rotatable covering 20, i.e. the bearing 19 which is firmly connected to the latter, by means of an upper supporting arm 43 which extends inwards substantially radially.

Figure 3:
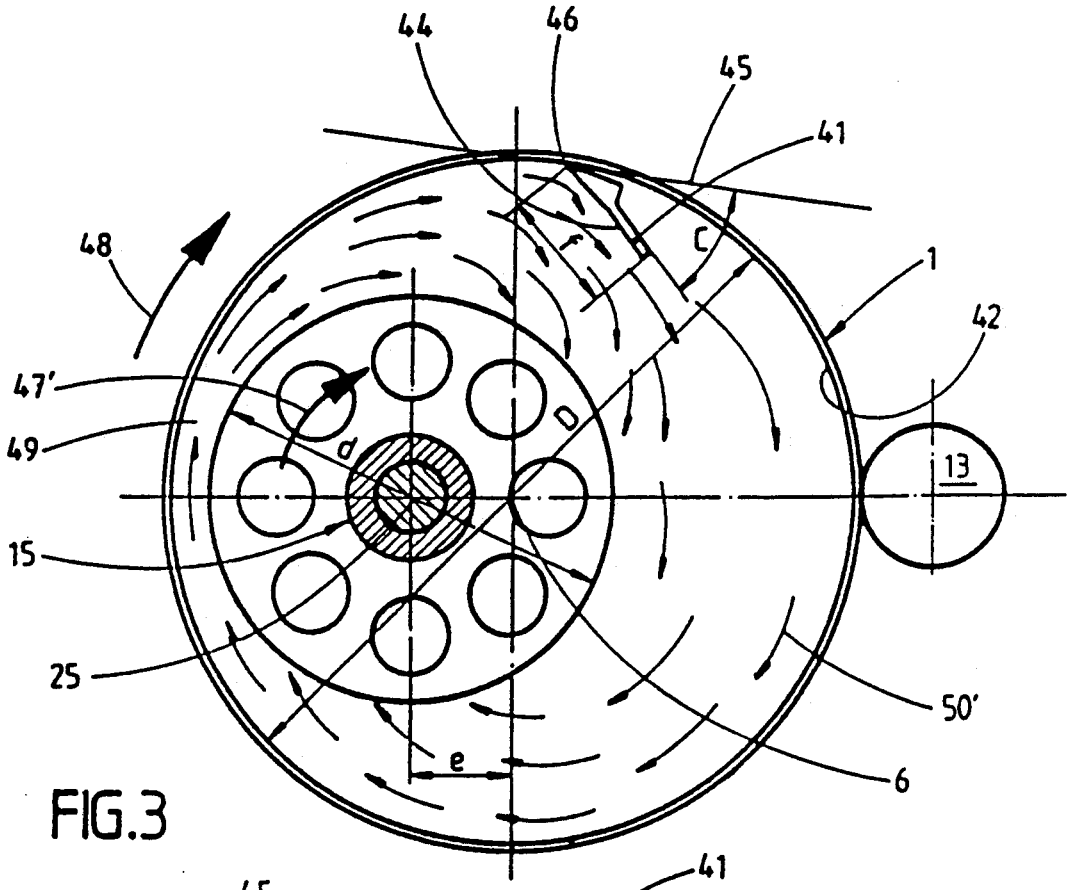
FIG. 3 shows a cross-section of the agitator ball mill according to FIG. 1 in a design for the drive, in the same direction, of agitator and grinding container.
Figure 2:
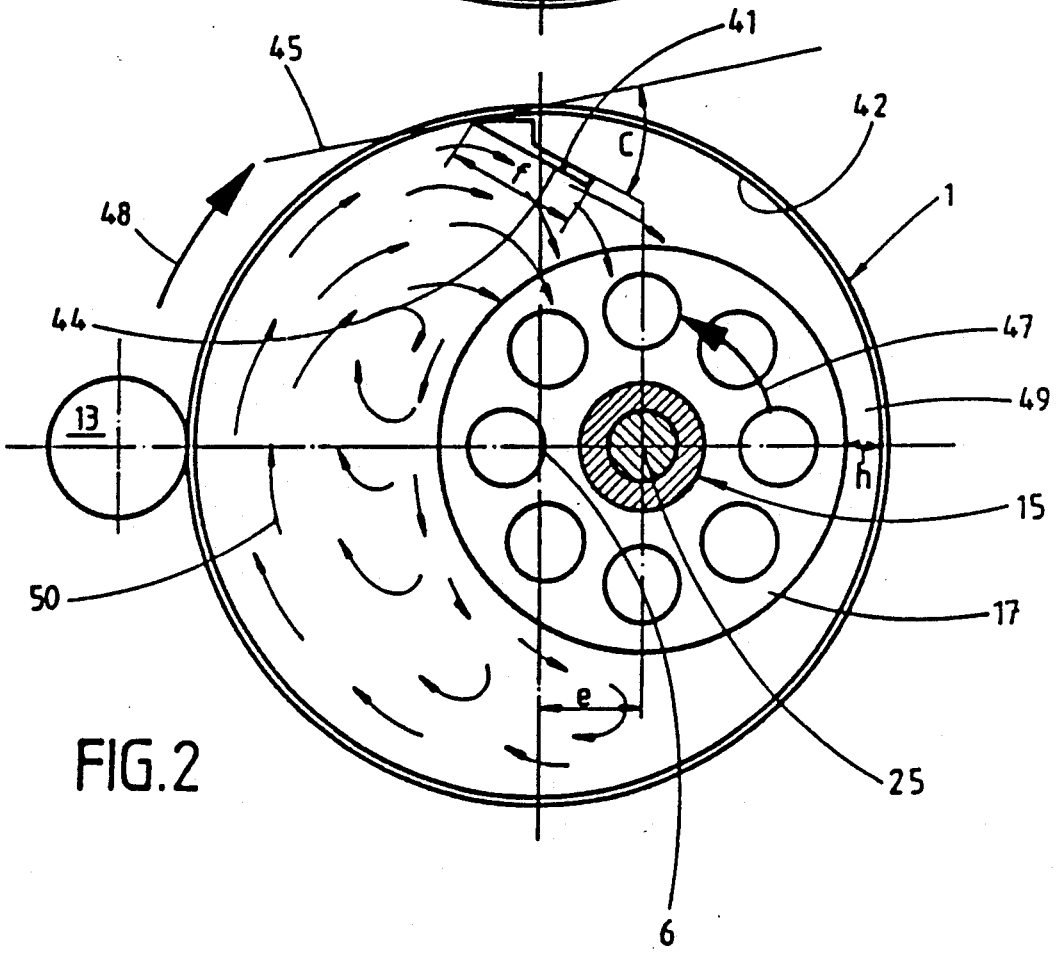
FIG. 2 shows a cross-section of the agitator ball mill according to FIG. 1 in a design for the drive, in opposite directions, of grinding container and agitator.

As can be seen, in particular, in FIGS. 2 and 3, the deflector 41, which is provided with a deflecting face 44 which is designed to be flat or, optionally, also arched, and which faces the axis 6, is not arranged radially and not tangentially with respect to the cylindrical grinding-chamber wall 42, but is set at an angle c relative to a tangent 45 through the grinding-chamber wall 42 which is between 10° and 50°. The deflector 41 is always arranged such that it deflects radially inwards an impacting flow of grinding stock/auxiliary grinding bodies, for which purpose it is, of course, designed to be adequately rigid or stiff. It has a point 46 which faces the grinding-chamber wall 42 so that it can also serve as a grinding-chamber-wall stripping device. Cross-sectionally, the width f of the deflector 41 is approximately 5 to 20% of the diameter D of the grinding chamber 30. The eccentricity e is approximately 2.5% to 15% of the grinding-chamber diameter D. The stipulation $D > d + e$ is applicable in respect of the diameter d of the agitator 15. The deflector 41 tapers downward from the top, i.e. its width f is smaller in the vicinity of the bottom 7 than at the upper end. The purpose hereof is to prevent compressions of the auxiliary grinding bodies 33, in particular when starting up the agitator ball mill. The above region of the width f refers to the wide and to the narrow end of the deflector 41.

The direction of rotation 47 of the agitator 15 will, as a rule, be in a direction opposite to the direction of rotation 48 of the grinding container 1 (see FIG. 2). In general, the circumferential velocity of the agitator 15 should be greater than the circumferential velocity of the grinding-chamber wall 42, in order to obtain higher flow rates of the grinding stock in the region of the agitator 15 and, in particular, in the region between the agitating tools 17, since the clear flow cross-section for the grinding stock is reduced in this region due to the presence of the agitating tools 17. The direction of rotation 47' of the agitator 15 can, however, also be in the same direction as the direction of rotation 48 of the grinding container 1 (see FIG. 3). Such a drive in the same direction of grinding container 1 and agitator 15 can be expedient in the case of not readily free-flowing grinding stock, since it is hereby prevented that the not readily free-flowing grinding stock is merely turned around in certain regions, which could otherwise be the case when opposing flows meet, in the case of driving of grinding container 1 and agitator 15 in opposite directions. In the case of a drive, in the same direction, a pumping effect sets in in the region of a contraction of the cross-section of the grinding chamber between agitator 15 and grinding-chamber wall 42, due to the eccentric arrangement of the agitator 15 relative to the grinding container 1, which pumping effect prevents that the grinding stock is locally merely rotated.

As can be seen in FIG. 2, in the case of a drive in opposite directions, the deflector 41 is arranged at the beginning of such a contracted cross-sectional region 49 between grinding-chamber wall 42 and agitator 15, the contracted cross-sectional region 49 being the half of the grinding chamber in which the agitator 15 is arranged and which is defined by a (imaginary) central longitudinal plane in which is accommodated the axis 6 and which is normal to the plane in which are disposed the axes 6 and 25.

In the case of a drive in the same direction, the deflector 41 is arranged, according to FIG. 3, at the end of the contracted cross-sectional region 49. The flows setting in are indicated by flow-direction arrows 50 (FIG. 2) and 50' (FIG. 3).

The comminution effect per se takes place in the usual manner in that the auxiliary grinding bodies 33 are accelerated or slowed down by the agitator 15 and the grinding-chamber wall 42, respectively, and the solid matter comprised in the grinding stock are crushed by the movement of the auxiliary grinding bodies 33 and are dispersed in the liquid. The smallest distance h between agitator 15 and grinding-chamber wall 42, i.e. between the respective outer end of an agitating tool 17 and the grinding-chamber wall 42, is in a range of 3 to 15% of the diameter D of the grinding chamber 30. As can also be seen in the drawing, the total volume of the agitator 15 is small relative to the volume of the grinding chamber 30. It is, in any event, at most 20% of the volume of the grinding chamber 30. As a rule, the volume of the agitator 15 will be less than 10% of the volume of the grinding chamber 30.

In so far as parts which are described in the following forms of embodiment are identical with previously described parts, identical reference numbers are used, without necessitating a repeated description. In so far as parts, in the case of the form of embodiment according to FIG. 4, are functionally identical and only constructively insignificantly different, the same reference numbers are used with an added "a", without it necessitating a repeated description in detail in this regard.

Figure 4:
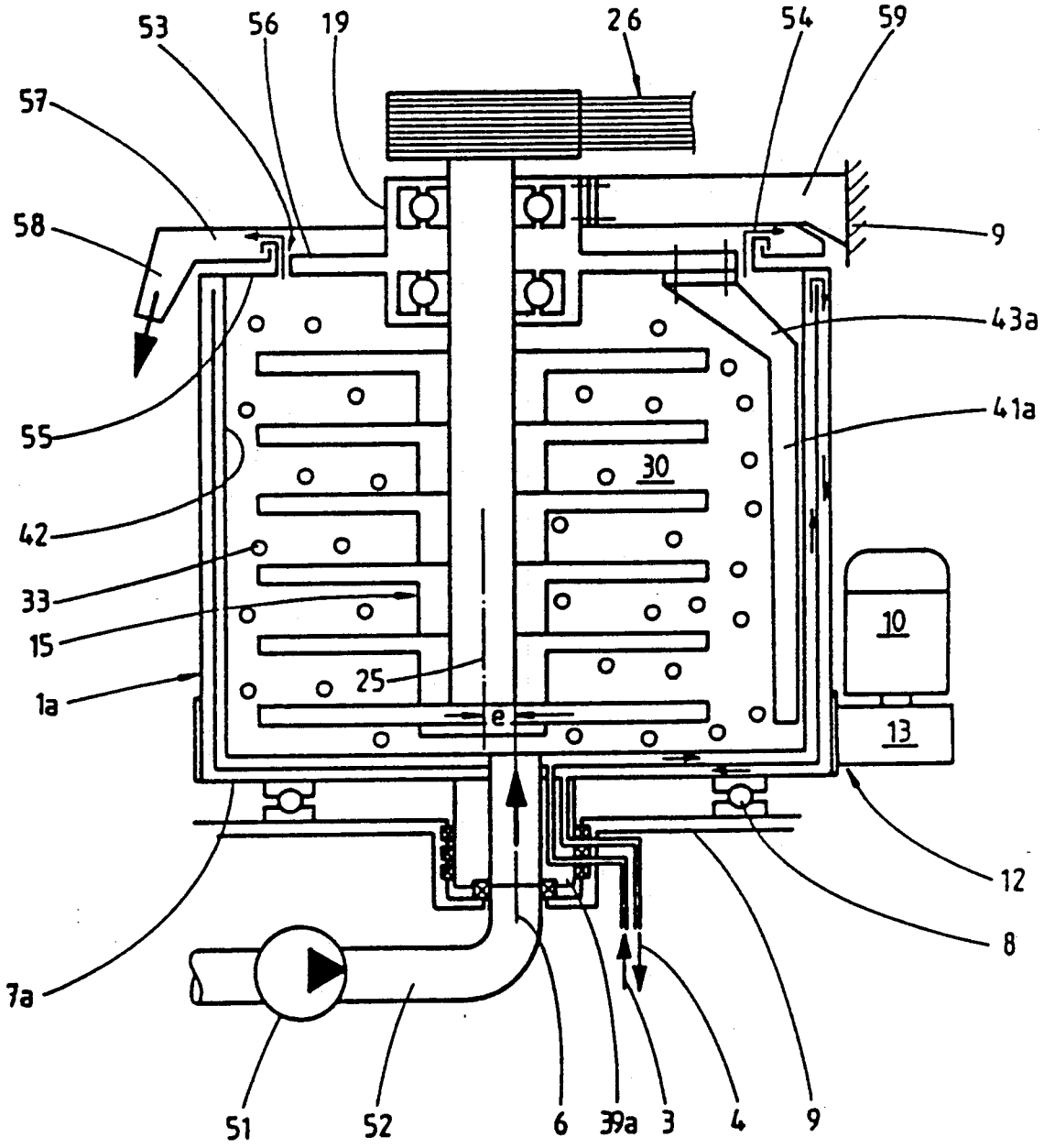
FIG. 4 shows a diagrammatic representation of a vertical central longitudinal section of a second form of embodiment of an agitator ball mill according to the invention.

In the case of the agitator ball mill according to FIG. 4, grinding stock is supplied as a suspension, i.e. in the form of solid matter suspended in liquid, through the bottom 7a of the grinding container 1a, by means of a grinding-stock pump 51 via a grinding-stock feed pipe 52. The supply takes place by means of a known rotating pipe coupling 39a, through which are also directed the inlet 3 and the outlet 4 for the tempering medium. The removal of the ground grinding stock takes place in the upper region of the grinding container 1a through an annular-passage separating device 53. The latter comprises a separating slot 54, which is formed between a ring 55, which is firmly connected to the upper side of the grinding container 1a, and a cover disc 56 which is attached to the bearing 19 of the agitator shaft. With regard to its width, relative to the diameter of the smallest auxiliary grinding bodies 33, the statements made in connection with FIG. 1 apply. The grinding stock freed of auxiliary grinding bodies 33 runs into an annular discharge cup 57 downstream of the separating device 53, and thence into a discharge channel 58. The bearing 19 is, in the case of this embodiment, secured to the machine frame 9 by means of a bracket 59. The deflector 41a is attached to the cover disc 56 and is therefore also fixed in position relative to the grinding container 1a and relative to the agitator 15.

Figure 5:
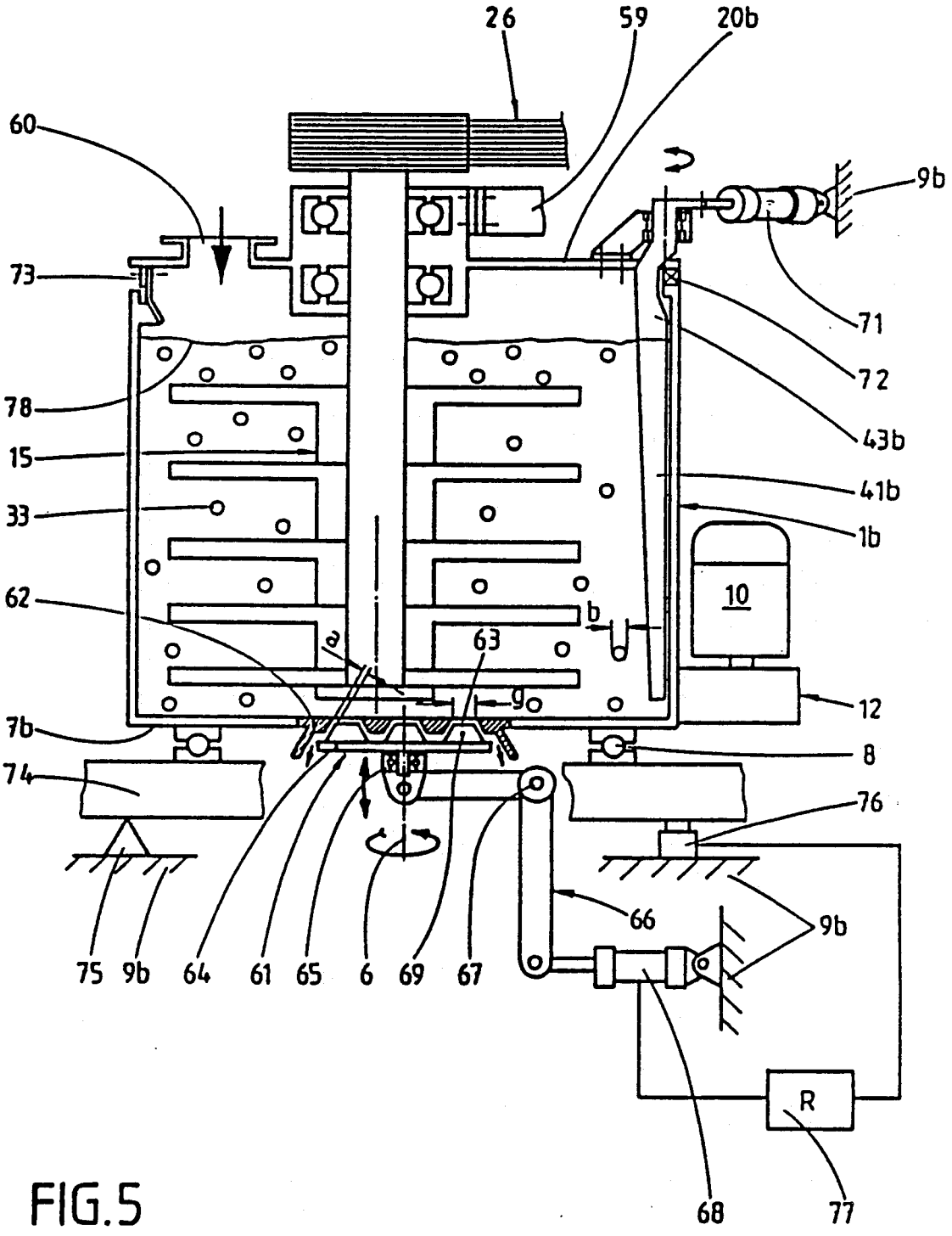
FIG. 5 shows a diagrammatic representation of a vertical central longitudinal section of a third form of embodiment of an agitator ball mill according to the invention.

In so far as, in the exemplified embodiment according to FIG. 5, functionally identical but constructively slightly changed parts are provided in the parts described above, the previous reference numerals are used with the addition of a "b", without it necessitating, in each case, a separate new description. The grinding container 1b is illustrated without a tempering jacket merely for reasons of simplifying the drawing. It comprises, in its covering 20b, which is firmly connected to the agitator-shaft bearing 19, a grinding-stock-addition opening 60, through which the grinding stock can be introduced into the grinding chamber 30, either in the form of dry solid matter, a premixed suspension or in separate addition flows of solid matter and liquid. The bearing 19 and, therefore, also the covering 20b are supported with respect to the machine frame 9b by means of a bracket 59 which is merely indicated.

In the bottom 7b of the grinding container 1b, and concentrically with its central longitudinal axis 6, a grinding-stock/auxiliary-grinding-bodies-separating device 61 is provided, which comprises, placed in position in the bottom 7b, a discharge plate 62, the delivery openings 63 of which have a diameter g which is distinctly greater than the diameter b of the auxiliary grinding bodies 33. Also provided is a sealing plate 64, which is arranged below the discharge plate 62 and which is supported on a rectangular lever 66 via a pivot bearing 65. The rectangular lever 66 is pivotingly supported on the machine frame 9b via its central pivot bearing 67. An adjusting drive 68, which is designed an hydraulically or pneumatically loaded piston/cylinder drive, and which is also supported on the machine frame 9b, acts on its other end. The delivery openings 63 of the discharge plate 62 are widened frusto-conically, i.e. conically downward. Arranged therein are appropriate packing bodies 69 which are arranged on the sealing plate 64. When the sealing plate 64 is brought into its position nearest to the discharge plate 62, by appropriate actuation of the adjusting drive 68, then one packing body 69, in each case, seals one delivery opening 63 of the discharge plate 62. When the adjusting drive 68 is moved into its opposite position, in which the sealing plate 64 is completely lifted off downward from the discharge plate 62, then the filling of auxiliary grinding bodies 33 can be removed downward through the delivery openings 63. In the case of a slightly downwardly lifted-off sealing plate 64, separating slots 70 are formed between the packing bodies 69 and the discharge plate 62, which are dimensioned such, due to a corresponding control of the adjusting drive 68, that the auxiliary grinding bodies 63 are retained in the grinding chamber 30, but grinding stock is removed downwards. Depending on the control of the adjusting drive 68, it is therefore possible to set the width a of the separating slot 70 and, thus, the speed of removal of the grinding stock.

The deflector 41b is pivotingly supported in the covering 20b via its supporting arm 43b. The pivoting movements can be carried out with the aid of a pivot drive 71, which is designed as a hydraulically or pneumatically loaded piston/cylinder drive and which is secured on the machine frame 9b. The sealing between the non-rotating covering 20b and the rotationally driven grinding container 1b is provided either by a slide-ring packing 72 (see FIG. 5, right-hand side) or by means of a lip seal 73 (see FIG. 5, left-hand side).

In the design according to FIG. 5, the pivot bearing 8 is supported not directly on the machine frame 9b, but on a weighing table 74. The latter is supported on the machine frame 9b, on the one hand, via a hinged bearing 75, for example a so-called knife-edge bearing, and, on the other hand, via a mass-measuring device 76, for example a so-called load cell. The adjusting drive 68 is controlled by the measuring device 76 via a control unit 77 in such a way that the total mass of the agitator mill together with the filling of grinding stock/auxiliary grinding bodies remains constant, i.e. the grinding-stock filling level 78 of the grinding chamber 30 is maintained to be constant. In other words, this means that the discharge of grinding-stock is controlled such that the quantity of grinding stock removed per unit of time is identical with the quantity of components supplied per unit of time.

Figure 6:
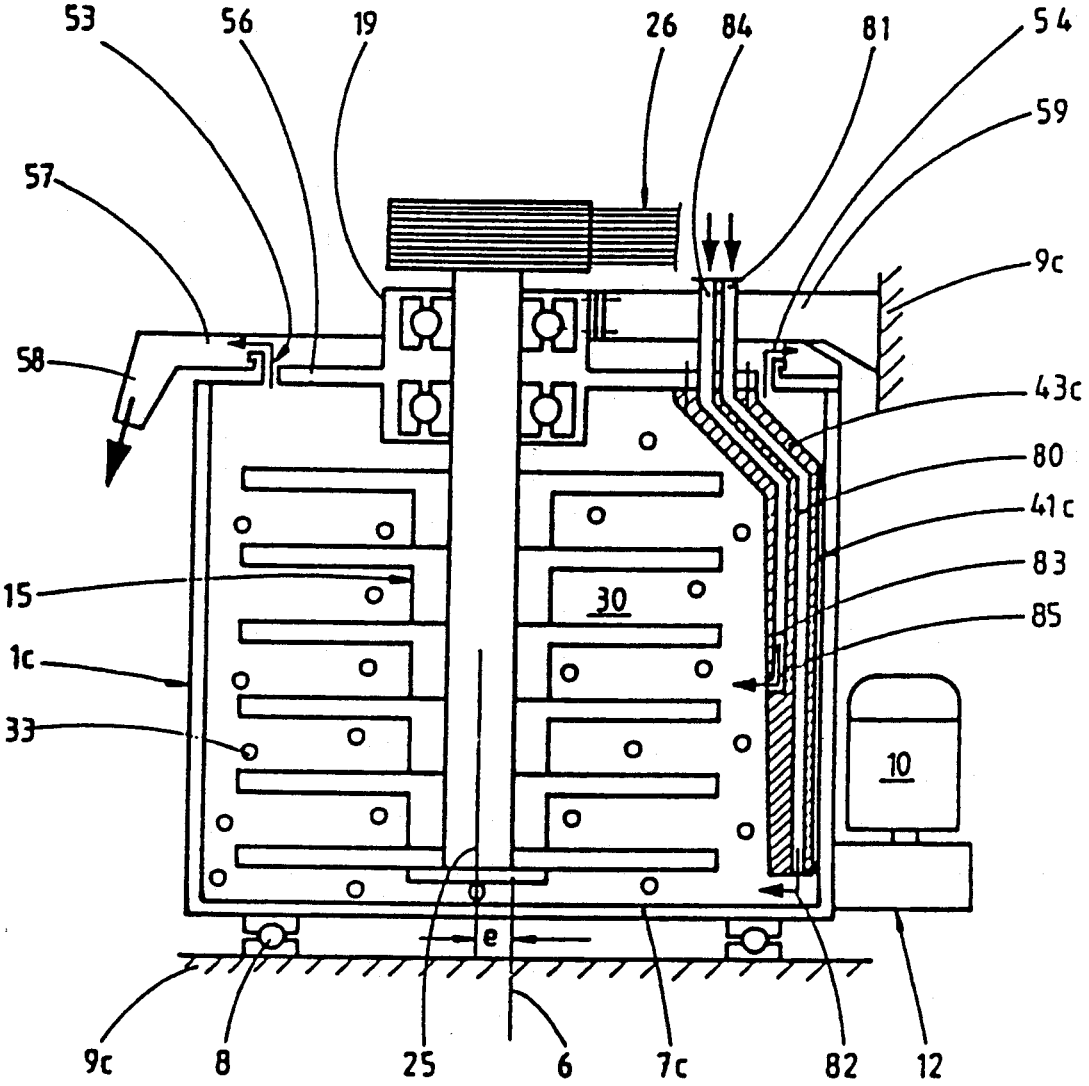
FIG. 6 shows a diagrammatic representation of a vertical central longitudinal section of a fourth form of embodiment of an agitator ball mill according to the invention.

Also again applicable in the case of the form of embodiment according to FIG. 6, is that parts, which are functionally identical but constructively different from previously described forms of embodiment, are designated with the same reference number with the addition of a "c", without there being provided, in each case, a separate description.

In the form of embodiment according to FIG. 6, the bottom 7c of the grinding container 1c is completely closed. The withdrawal of the grinding stock is carried out in the same manner as in the form of embodiment according to FIG. 4. For the purpose of supplying the grinding stock, a feed duct 80 is provided in the deflector 41c, which feed duct is connected to a feed pipe guided from outside to the cover lid 56 and the feed opening 82 of which is in the vicinity of the bottom 7c. In the deflector 41c, a further feed duct 83 may be provided which is also connected to an outer feed pipe 84 and the feed opening 85 of which can open up into the grinding chamber 30 distinctly above the bottom 7c in the axial central region of said grinding chamber. Through this second feed duct 83, it is possible to supply, for example, a further component which is to be supplied only when the grinding stock component, which has been supplied through the first feed duct 80 in the vicinity of the bottom 7c, has also already been subjected to a certain comminution procedure.

Figure 7:
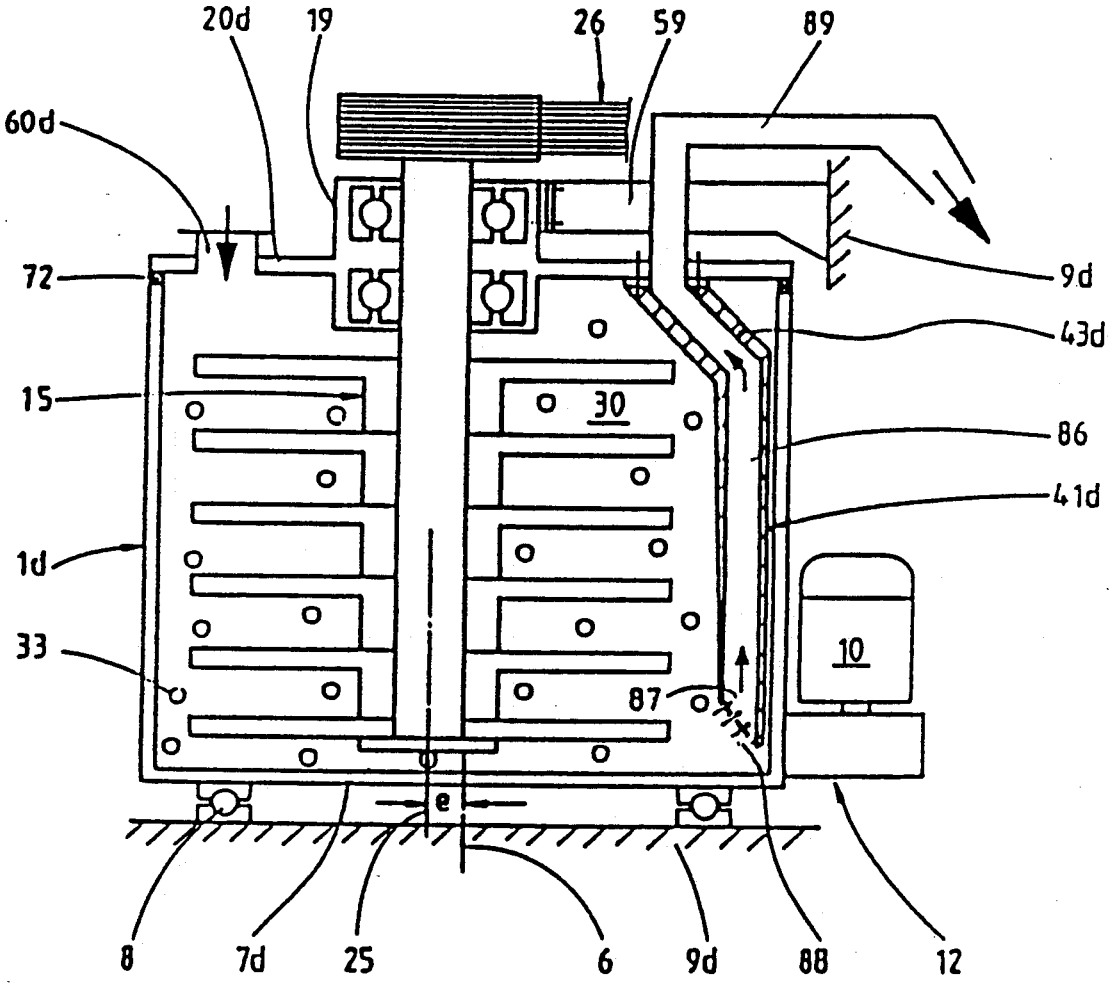
FIG. 7 shows a diagrammatic representation of a vertical central longitudinal section of a fifth form of embodiment of an agitator ball mill according to the invention.

In respect of the form of embodiment according to FIG. 7, it holds true that all parts which are functionally identical with, but constructively different from earlier forms of embodiment, are designated by the same reference numeral with an added "d". In the covering 20d of the grinding container 1d, a grinding-stock-addition opening 60d is provided. The bottom 7d is completely closed. The deflector 41d is designed to be hollow. This hollow space forms a grinding-stock-outlet duct 86, the grinding-stock-admission opening 87 of which is located in the vicinity of the bottom 7d. It is closed off by a separating device 88, for example a screen which permits the penetration of the grinding stock but which holds back the auxiliary grinding bodies 33 in the grinding chamber 30. The grinding stock flows through the outlet duct 86 into an outer grinding-stock outlet pipe 89. The outlet duct 86 can, in like manner as the feed ducts 80, 83 in the case of the exemplified embodiment according to FIG. 6, have a width of only a few millimetres; the outer profile of the deflector 41d or of the deflector 41c does therefore not need to be changed relative to the closed forms of embodiment according to the other exemplified embodiments.

Figure 8:
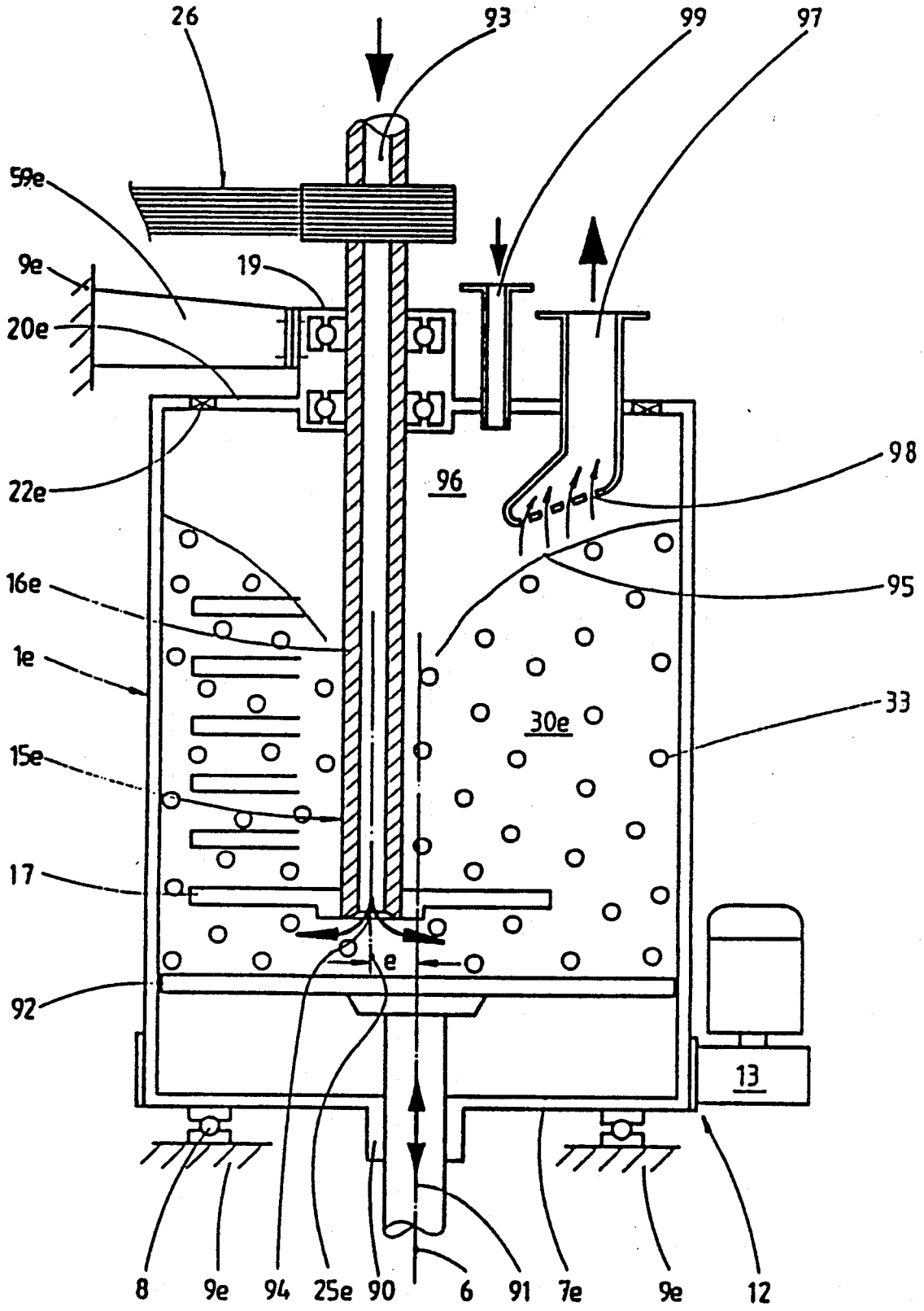
FIG. 8 shows a diagrammatic representation of a vertical central longitudinal section of a sixth form of embodiment of an agitator ball mill according to the invention.

In the design according to FIG. 8, the functionally identical parts which differ constructively from the previous exemplified embodiments are designated by the reference number previously used together with an added "e". The grinding container 1e is closed off with a bottom 7e in which, concentrically with the central longitudinal axis 6, a sliding guide 90 is provided for a guide rod 91 which is displaceable in the direction of the axis 6 and on which is secured a grinding-chamber floor 92 which defines the grinding chamber 30e. As a result of appropriate displacements of the guide rod 91, with the aid of a drive means which is not illustrated, the grinding-chamber floor 92 is adjusted in the direction of the axis 6, as a result of which the volume of the grinding chamber 30e is increased or reduced. The agitating tools 17 of the agitator 15e are merely indicated. The agitator shaft 16e is designed to be hollow and has a grinding-stock feed duct 93 which, at the free end of the agitator shaft 16e, i.e. in the vicinity of the grinding-chamber floor 92, opens up into the grinding chamber 30e through an opening 94. As a result of the rotation of the agitating tool 17 adjoining the opening 94, the grinding stock supplied through the duct 93 is immediately brought into intensive contact with the bed of auxiliary grinding bodies 33.

Due to the rotary motions of grinding container 1e and agitator 15e, the surface 95 of the mixture of grinding stock/auxiliary grinding bodies forms a so-called funnel, i.e. the surface 95 becomes approximately trumpet-shaped. Between the surface 95 and the top covering 20e, there is, therefore, a free space 96 which is not filled with grinding stock and/or auxiliary grinding bodies 33. Provided in this free space 96, is a suction pipe 97 which is mounted in the nonrotating covering 20e and projects through the latter and which has, at its bottom side facing the surface 95, screen openings 98 which do not permit penetration by the auxiliary grinding bodies 33. The grinding stock, i.e. the fines component of the grinding stock, is removed by suction through the suction pipe 97. Also arranged in the covering 20e and directed into the fee space 96 is a scavenging-air nozzle 99, via which scavenging air is injected into the free space 96 which serves to clear by blowing any possibly clogged screen openings 98.

The grinding-chamber bottom 92 the elevation of which can be adjusted and which serves as lifting floor, serves not only the adjusting of a variable packing density of the auxiliary grinding bodies 33 in the grinding chamber 30e, but also to provide the distance between the surface 94 of the mixture of grinding stock/auxiliary grinding bodies and the screen openings 98 of the suction pipe 97. In FIG. 8, the deflector is not illustrated; it can be designed in the same manner as illustrated in FIG. 4.

Figure 9:
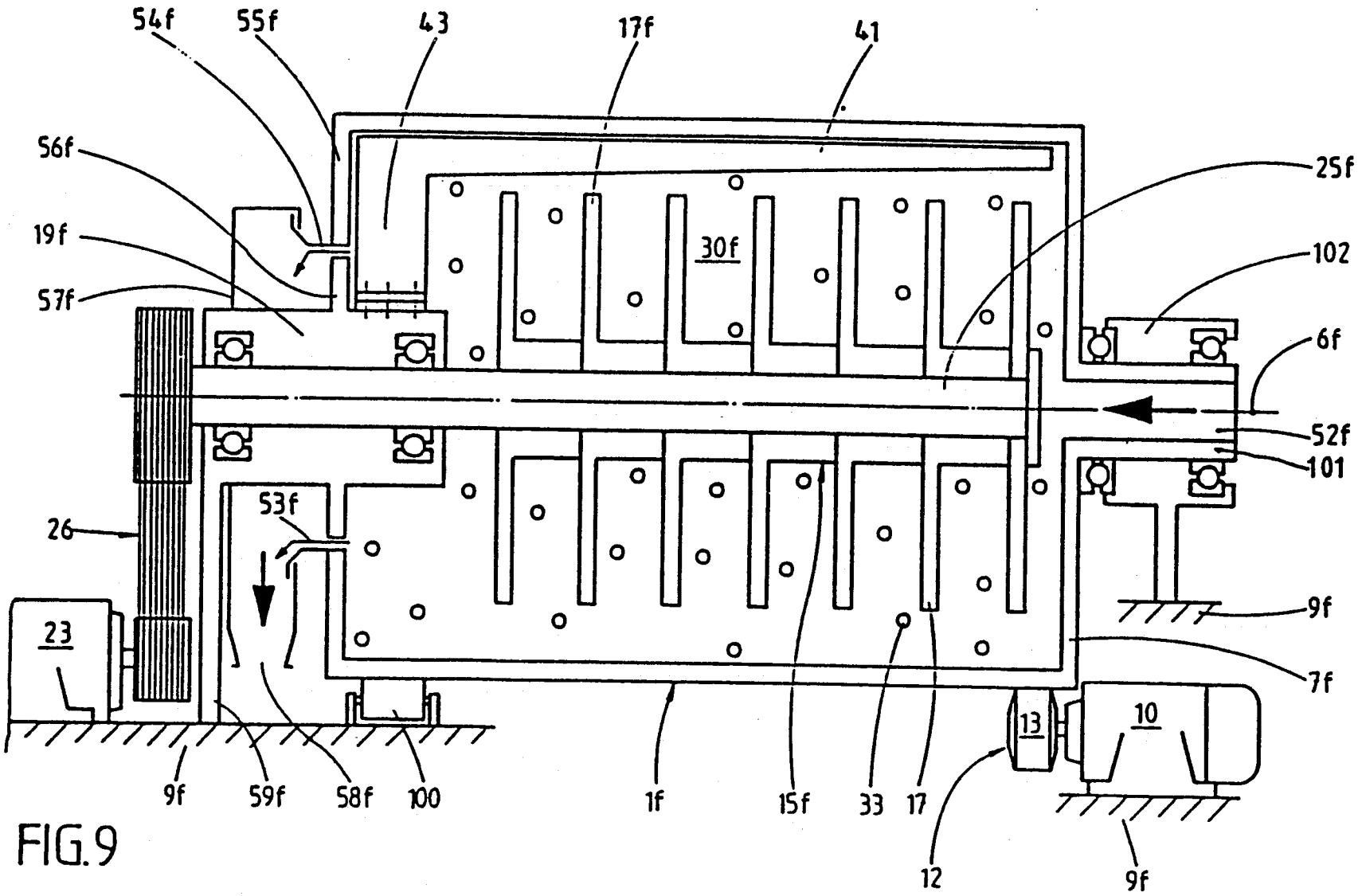
FIG. 9 shows a diagrammatic representation of a vertical central longitudinal section of a seventh form of embodiment of an agitator ball mill according to the invention.
Figure 11:
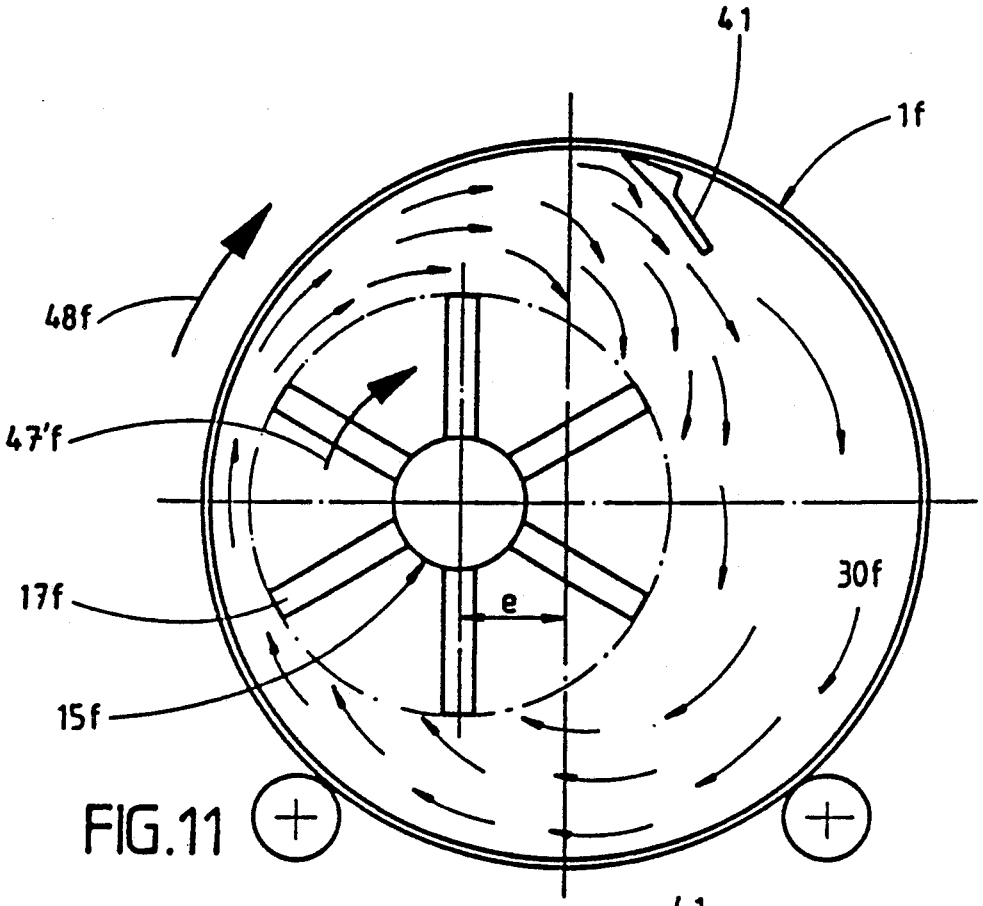
FIG. 11 shows a section of an agitator ball mill according to FIG. 9 in a design for the drive, in the same direction, of agitator and grinding container.
Figure 10:
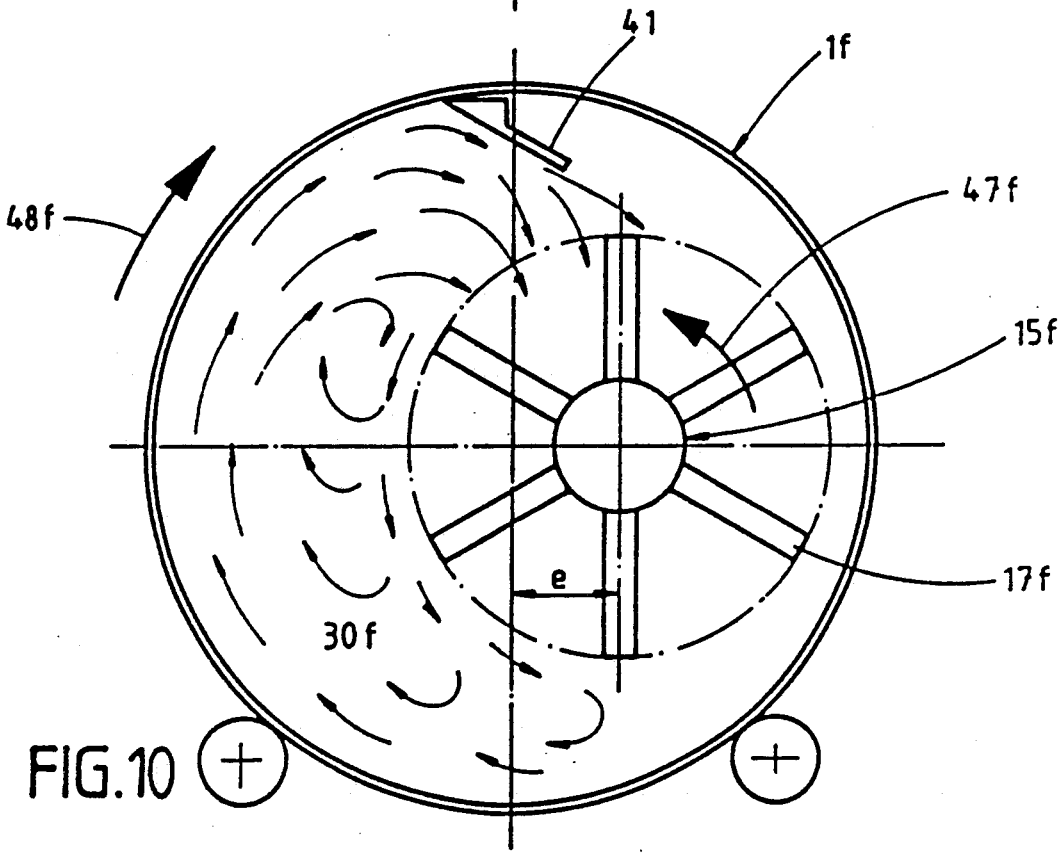
FIG. 10 shows a section of an agitator ball mill according to FIG. 9 in a design for the drive, in opposite directions, of agitator and grinding container.

In the case of the form of embodiment of an agitator ball mill according to FIGS. 9 to 11, parts which are functionally identical with but constructively different from the forms of embodiment described above, are also designated by the same reference number and an added "f". In contrast to the forms of embodiment previously described, which related to vertical agitator ball mills, the agitator ball mill in this instance is a so-called horizontal agitator ball mill. The central longitudinal axis 6f of the grinding container 1f thus extends horizontally. The same applies in respect of the agitator axis 25f of the agitator 15f. The agitator shaft 16 is, likewise, overmounted in an agitator-shaft bearing 19f which is supported, by means of a bracket 59f, on the machine frame 9f. The agitating tools 17f are, in this case, designed as agitating arms.

In the region of the agitator-shaft bearing 19f, the grinding container 1f is supported with respect to the machine frame 9f by means of supports rollers 100. In the opposite region of the bottom 7f which forms an end face, the grinding container 1f is provided with a hollow shaft journal 101 which is arranged concentrically with the axis 6f and which is supported with respect to the machine frame 9f via a bearing 102. A grinding-stock feed pipe 52f, through which the grinding stock is admitted into the grinding chamber 30f, is directed through the hollow shaft journal 101. The withdrawal of the ground grinding stock is carried out through an annular-passage separating device 53f, which is provided between the cover disc 56f and the ring 55f. The rotary drive of the grinding container 1f is, in this case too, provided by a grinding-container driving motor 10 and a friction gear 12. The deflector 41 is arranged, in each case, in the top region, i.e. in the region of the vertex line of the grinding container 1f, in the case of the drive of grinding container 1f and agitator 15f in opposite directions (see FIG. 10) and also in the case of the drive of agitator 15 and grinding container 1f in the same direction (see FIG. 11). In that region, the concentration of auxiliary grinding bodies 33 is lowest due to the force of gravity acting on them. For the rest, and with regard to the arrangement of the deflector 41, what has been set out in connection with the form of embodiment according to FIGS. 1 to 3, is applicable.

Figure 12:
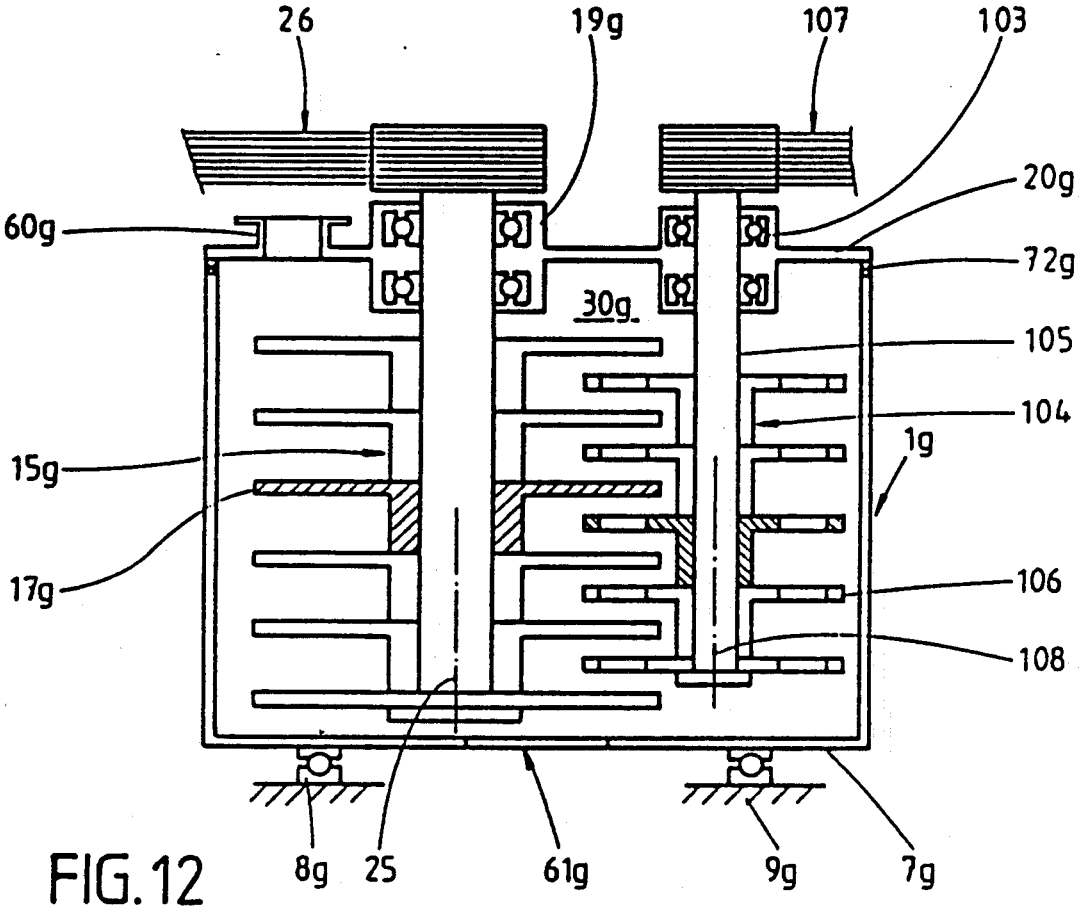
FIG. 12 shows a diagrammatic representation of a vertical central longitudinal section of an agitator ball mill according to the invention, having two agitators.
Figure 13:
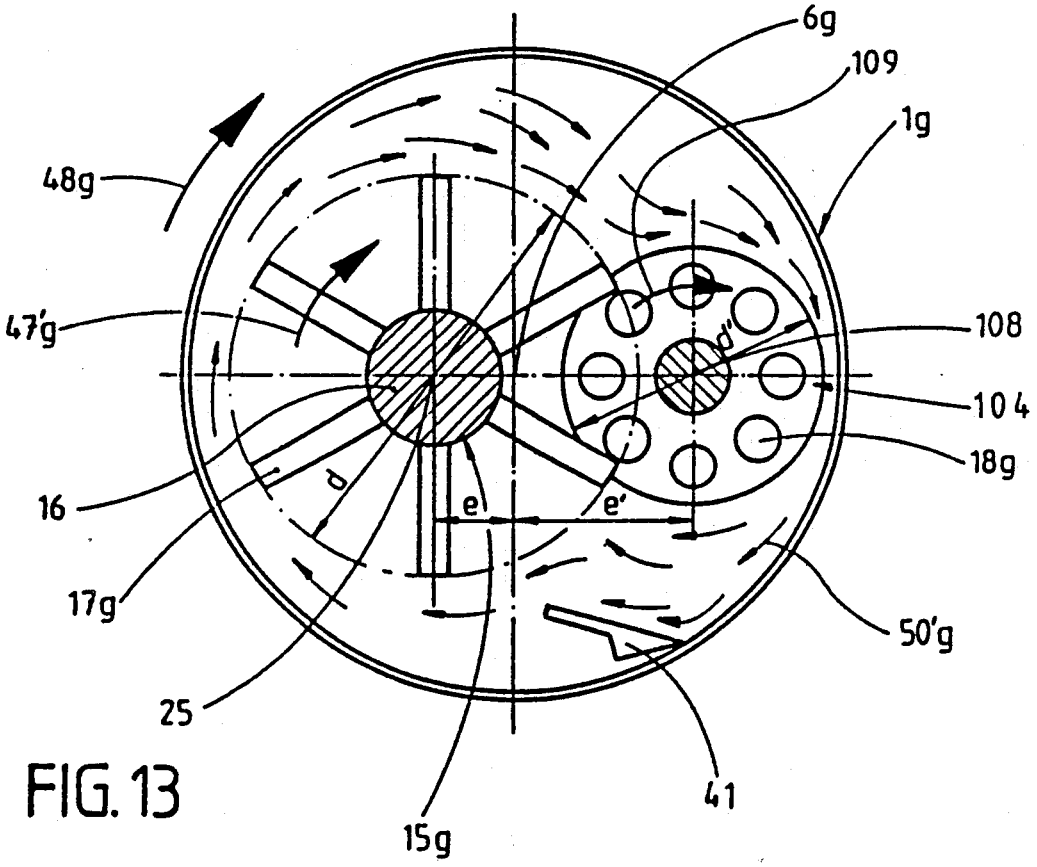
FIG. 13 shows a horizontal section of the agitator ball mill according to FIG. 12.

In the form of embodiment of an agitator ball mill according to FIGS. 12 and 13, the same reference numbers with an added "g" are again used in respect of parts which are functionally identical with but constructively different from previously described forms of embodiment, without there being a separate description. An agitator 15g, which is provided with agitating tools 17g in the form of radially projecting rods, is arranged in the grinding container 1g. A second agitator 104 having an agitator shaft 105 and agitating tools 106 is supported, likewise by means of an agitator-shaft bearing 103, in the covering 20g. Said agitating tools radially overlap the agitating tools 17g of the agitator 15g and are axially offset relative thereto, so as to prevent collisions. The agitators 15g and 104 have different diameters d and d', respectively. The drive of the second agitator 104 is provided via a belt drive 107 from a motor which is not illustrated. The eccentricity e' of the axis 108 of the second agitator relative to the axis 6g of the grinding container 1g is different from the eccentricity e. As can be seen from FIG. 13, the grinding container 1g, the agitator 15g and the agitator 104 rotate in the same direction, the direction of rotation of the second agitator being designated by 109. It is, of course, possible to apply any desirable and possible combinations of opposing directions of rotation.

The statements made concerning the distance of the agitator 15g from the grinding-chamber wall are also applicable in respect of the second agitator 104. The statement also applies to both agitators 15g and 104 that their total volume amounts at most to 20% of the volume of the grinding chamber 30g.

I claim:

1. Agitator ball mill comprising a grinding container (1) having a cylindrical grinding chamber (30) which is defined by a grinding-chamber wall (42), and a central longitudinal axis (6) and at least one agitator (15, 104) which is arranged in said grinding chamber (30) and is provided with projecting agitating tools (17, 106) and has an agitator axis (25, 108) which extends parallel with the central longitudinal axis (6) of the grinding chamber (30), wherein the agitator (15, 104) and the grinding container (1), can be rotationally driven about their respective axes (25, 108; 6) by means of a drive, wherein the grinding chamber (30) is partially filled with auxiliary grinding bodies (33) which are fairly freely movable in a mixture of grinding stock and auxiliary grinding bodies, and wherein the grinding chamber (30) is provided with a grinding-stock feed means (29, 52, 60, 80, 83, 93) and a grinding stock discharge means comprising a separating device (35, 53, 61, 88, 98) for separating grinding-stock and auxiliary-grinding-bodies from each other, wherein the agitator axis (25, 108) has an eccentricity (e, e') relative to the central longitudinal axis (6) of the grinding chamber (30), and wherein, in the region of the grinding-chamber wall (42), at least one stationary deflector (41) is provided which is directed from the grinding-chamber wall (42) into the grinding chamber (30) and which extends across a substantial portion of the length of the grinding chamber (30) in the direction of its central longitudinal axis (6) and which has a deflecting face (44) which is open in the direction of the central longitudinal axis (6), and wherein the deflector (41) is arranged in the region of transition to a contracted cross-sectional region (49) of the grinding chamber (30), the agitator axis (25) being arranged in the contracted cross-section (49) and the latter being defined by a plane disposed through the central longitudinal axis (6), which plane is disposed to be normal to a plane which is set through central longitudinal axis (6) and the agitator axis (25).

2. Agitator ball mill according to claim 1, wherein an edge (46) of the deflector (41) projects into the vicinity of the grinding-chamber wall (42).

3. Agitator ball mill according to claim 2, wherein the deflecting face (44) of the deflector (41) is arranged downstream of the edge (46) of the deflector (41), relative to the direction of rotation (48) of the grinding container (1).

4. Agitator ball mill according to claim 1, wherein the deflecting face (44) of the deflector (41) forms an angle (c) of 10° to 50° with a tangent (45) on the grinding-chamber wall (42).

5. Agitator ball mill according to claim 1, wherein the deflector (41) forms an adjustable angle (c) with a tangent (45) on the grinding-chamber wall (42).

6. Agitator ball mill according to claim 5, wherein the deflector (41) is pivotingly supported in a stationary boundary wall of the grinding chamber (30).

7. Agitator ball mill according to claim 1, wherein $0.05D \leqq f \leqq 0.2D$ is approximately applicable in respect of the width (f) of the deflector (41) relative to the diameter (D) of the grinding chamber (30).

8. Agitator ball mill according to claim 1, wherein $0.1D \leqq e \leqq 0.4D$ is applicable in respect of the eccentricity (e) of the agitator axis (25) relative to the diameter (D) of the grinding chamber (30).

9. Agitator ball mill according to claim 1, wherein the direction of rotation (48) of the grinding container (1) and the direction of rotation (47) of the agitator (15) are in opposite direction to each other and wherein the deflector (41) is arranged at the beginning of the contracted cross-sectional region (49), relative to the direction of rotation (48) of the grinding container (1).

10. Agitator ball mill according to claim 1, wherein the direction of rotation (48) of the grinding container (1) and the direction of rotation (47') of the agitator (15) are in the same direction with respect to each other and wherein the deflector (41) is arranged at the end of the contracted cross-sectional region (49), relative to the direction of rotation (48) of the grinding container (1).

11. Agitator ball mill according to claim 1, wherein the agitator axis (25f) and the central longitudinal axis (6f) extend approximately horizontally, and wherein the deflector (41) is arranged in the top region of the grinding chamber (30f).

12. Agitator ball mill according to claim 1, wherein the agitator axis (25e) and the central longitudinal axis (6) of the grinding chamber (30*e*) are arranged substantially vertically and wherein, in an upper free space (96) of the grinding chamber (30*e*), which free space is not filled with a mixture of grinding stock/auxiliary grinding bodies, a suction device (97) for the fines component of the grinding stock is arranged.

13. Agitator ball mill according to claim 12, wherein a grinding-chamber floor (92) is provided which defines the grinding chamber (30*e*) and which is displaceable in the direction of the central longitudinal axis (6).

14. Agitator ball mill according to claim 12, wherein the agitator (15) is provided with a grinding-stock-feed duct (93) which, in the region of a floor (92) defining the grinding chamber (30*e*), opens up into the grinding chamber (30*e*) by means of an opening (94).

15. Agitator ball mill according to claim 12, wherein a scavenging-air nozzle (99) for the supply of scavenging air opens up into the free space (96).

16. Agitator ball mill according to claim 1, wherein a grinding-chamber floor (92) is provided which defines the grinding chamber (30*e*) and which is displaceable in the direction of the central longitudinal axis (6).

17. Agitator ball mill according to claim 1, wherein the agitator (15) is provided with a grinding-stockfeed duct (93) which, in the region of a floor (92) defining the grinding chamber (30*e*), opens up into the grinding chamber (30*e*) by means of an opening (94).

18. Agitator ball mill according to claim 1, wherein, in the grinding chamber (30*g*) are arranged a plurality of agitators (159, 104), the agitator axes (25, 108) of which have varying eccentricities (e, e') relative to the central longitudinal axis (6*g*) of the grinding chamber (30*g*).

19. Agitator ball mill according to claim 18, wherein the agitating tools (17*g*, 106) of the agitators (15*g*, 104) are axially offset with respect to one another and partially overlap one another radially.

20. Agitator ball mill according to claim 18, wherein the agitators (15*g*, 104) have different diameters (d, d').

21. Agitator ball mill according to claim 1, wherein the agitator axis (25) and the central longitudinal axis (6) of the grinding chamber (30) are arranged approximately vertically and wherein the grinding-stock-feed means is arranged in a top covering (20) and the grinding-stock/auxiliary-grinding-bodies separating device (35, 61) is arranged in the opposite lower bottom (7).

22. Agitator ball mill according to claim 21, wherein the separating device (35) is designed as an annular-passage separating device (35) formed by a separating slot (38) which extends conically between a ring (36), which rotates with the grinding container (1), and a disc (37), the disc (37) being designed to be displaceable in the direction of the central longitudinal axis (6), for the purpose of changing the slot width (a).

23. Agitator ball mill according to claim 22, wherein the disc (37) can be rotationally driven relative to the ring (36).

24. Agitator ball mill according to claim 21, wherein the grinding-stock/auxiliary-grinding-bodies separating device (61) is provided with a plurality of delivery openings (63), the diameter (g) of which is greater than the diameter (b) of the largest auxiliary grinding bodies (33) and wherein a sealing plate (64) is provided which can be advanced against the delivery openings (63) or removed downwards away from them.

25. Agitator ball mill according to claim 24, wherein the sealing plate (64) is supported to be freely rotating.

26. Agitator ball mill according to claim 25, wherein the delivery openings (63) are designed to widen up frusto-conically in a downward direction and wherein packing bodies (69) are arranged on the sealing plate (64), which packing bodies are adapted in shape and cross-section to the delivery openings (63), and between which and the respective delivery opening (63), separating slots (70) of varying width (a) can be provided by the appropriate adjusting of the sealing plate (64) relative to the delivery openings (63).

27. Agitator ball mill according to claim 1, wherein the grinding container (1*b*) is supported, via a weighing means (76), on a machine frame (9*b*) and wherein the separating device (61) for separating grinding stock and auxiliary-grinding-bodies is controllable for the purpose of changing the discharge of grinding stock.

28. Agitator ball mill according to claim 1, wherein $0.3D \leqq d \leqq 0.8D$ and $0.3D \leqq d' \leqq 0.8D$ is applicable in respect of the diameter (d, d') of the agitator (15, 104) relative to the diameter (D) of the grinding container (1).

29. Agitator ball mill according to claim 1, wherein a rotating pipe coupling (39*a*) which is arranged concentrically with the central longitudinal axis (6) of the grinding container (1*a*), is provided for the feed of grinding stock.

30. Agitator ball mill according to claim 1, wherein $0.03D \leqq h \leqq 0.15D$ is applicable in respect of the smallest distance (h) of the agitator (15) from the grinding-chamber wall (42) in comparison with the diameter (D) of the grinding chamber (30).

31. Agitator ball mill according to claim 1, wherein the volume of the agitator (15) is at most 20% of the volume of the grinding chamber (30).

32. Agitator ball mill according to claim 1, wherein the central longitudinal axis (6) of the grinding chamber (30) is essentially vertically arranged and wherein the deflector (41) tapers in a downward direction from the top.

33. Agitator ball mill according to claim 1, wherein an edge (46) of the deflector (41) projects into the vicinity of the grinding-chamber wall (42) and wherein the deflector (41) forms an adjustable angle (c) with a tangent (45) on the grinding-chamber wall (42).

34. Agitator ball mill comprising a grinding container (1) having a cylindrical grinding chamber (30), which is defined by a grinding-chamber wall (42), and a central longitudinal axis (6) and at least one agitator (15, 104) which is arranged in said grinding chamber (30) and is provided with projecting agitating tools (17, 106) and has an agitator axis (25, 108) which extends parallel with the central longitudinal axis (6) of the grinding chamber (30), wherein the agitator (15, 104) and the grinding container (1), can be rotationally driven about their respective axes (25, 108; 6) by means of a drive, wherein the grinding chamber (30) is partially filled with auxiliary grinding bodies (33) which are fairly freely movable in a mixture of grinding stock and auxiliary grinding bodies, and wherein the grinding chamber (30) is provided with a grinding-stock feed means (29, 52, 60, 80, 83, 93) and a grinding-stock discharge means comprising a separating device (35, 53, 61, 88, 98) for separating grinding-stock and auxiliary-grinding-bodies from each other, wherein the agitator axis (25, 108) has an eccentricity (e, e') relative to the central longitudinal axis (6) of the grinding chamber (30), and wherein, in the region of the grinding-chamber wall (42), at least one stationary deflector (41) is provided which is directed from the grinding-chamber wall (42) into the grinding chamber (30) and which extends across a substantial portion of the length of the grinding chamber (30) in the direction of its central longitudinal axis (6) and which has a deflecting face (44) which is open in the direction of the central longitudinal axis (6), and wherein in the deflector (41*c*) is provided at least one feed duct (80, 83) for grinding stock to be ground which, with a feed opening (82, 85), opens up into the grinding chamber (30) and is connected to the grinding-stock-feed means (81, 84).

35. Agitator ball mill according to claim 34, wherein a plurality of feed ducts (80, 83) are provided, the feed openings (82, 85) of which open up into the grinding chamber (30) at a distance from each other.

36. Agitator ball mill comprising a grinding container (1) having a cylindrical grinding chamber (30), which is defined by a grinding-chamber wall (42), and a central longitudinal axis (6) and at least one agitator (15, 104) which is arranged in said grinding chamber (30) and is provided with projecting agitating tools (17, 106) and has an agitator axis (25, 108) which extends parallel with the central longitudinal axis (6) of the grinding chamber (30), wherein the agitator (15, 104) and the grinding container (1), can be rotationally driven about their respective axes (25, 108; 6) by means of a drive, wherein the grinding chamber (30) is partially filled with auxiliary grinding bodies (33) which are fairly freely movable in a mixture of grinding stock and auxiliary grinding bodies, and wherein the grinding chamber (30) is provided with a grinding-stock feed means (29, 52, 60, 80, 83, 93) and a grinding-stock discharge means comprising a separating device (35, 53, 61, 88, 98) for separating grinding-stock and auxiliary-grinding-bodies from each other, wherein the agitator axis (25, 108) has an eccentricity (e, e') relative to the central longitudinal axis (6) of the grinding chamber (30), and wherein, in the region of the grinding-chamber wall (42), at least one stationary deflector (41) is provided which is directed from the grinding-chamber wall (42) into the grinding chamber (30) and which extends across a substantial portion of the length of the grinding chamber (30) in the direction of its central longitudinal axis (6) and which has a deflecting face (44) which is open in the direction of the central longitudinal axis (6), and wherein in the deflector (41*d*) a grinding-stock outlet duct (86) is provided which is connected to the grinding chamber (30) via a grinding-stock-admission opening (87), a grinding-stock/auxiliary-grinding-bodies separating device (88) being arranged in the admission opening (87).

* * * * *